US009052681B2

(12) United States Patent
Nakai et al.

(10) Patent No.: US 9,052,681 B2
(45) Date of Patent: Jun. 9, 2015

(54) STATIC ELIMINATING DEVICE AND IMAGE FORMING APPARATUS

(71) Applicant: KYOCERA Document Solutions Inc., Osaka (JP)

(72) Inventors: Jun Nakai, Osaka (JP); Katsuya Ota, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 201 days.

(21) Appl. No.: 13/898,279

(22) Filed: May 20, 2013

(65) Prior Publication Data

US 2013/0315626 A1 Nov. 28, 2013

(30) Foreign Application Priority Data

May 23, 2012 (JP) ..... 2012-117901

(51) Int. Cl.

| | |
|---|---|
| ***G03G 15/00*** | (2006.01) |
| ***G03G 21/00*** | (2006.01) |
| ***G03G 15/04*** | (2006.01) |
| ***G03G 21/08*** | (2006.01) |
| ***G03G 21/06*** | (2006.01) |

(52) U.S. Cl.

CPC ..... *G03G 21/08* (2013.01); *G03G 21/06* (2013.01)

(58) Field of Classification Search

CPC ..... G03G 21/06; G03G 21/08
USPC ..... 399/118, 128, 186, 220
See application file for complete search history.

(56) References Cited

U.S. PATENT DOCUMENTS 5,065,188 A 11/1991 Kobayashi et al.
7,421,229 B2 9/2008 Tomiie et al.

(Continued)

FOREIGN PATENT DOCUMENTS

JP 56-095280 A 8/1981
JP 03-139673 A 6/1991

(Continued)

OTHER PUBLICATIONS

Notice of Rejection mailed by Japan Patent Office on Aug. 12, 2014 for Japanese patent application No. 2014-116558, which is a divisional application of JP 2012-117901.

(Continued)

*Primary Examiner* — David Gray
*Assistant Examiner* — Andrew V Do
(74) *Attorney, Agent, or Firm* — Knobbe, Martens Olson & Bear LLP

(57) ABSTRACT

A static eliminating device includes: a housing; a substrate mounted to the housing; a light-emitting part mounted on a mounting surface of the substrate; a partition member connected to the housing to cover the substrate and the light-emitting part and face a portion of the housing to which the substrate and the light-emitting part are mounted so that an opening facing the surface of the image carrier is formed in a light-emitting region across which light is delivered from the light-emitting part to the surface of the image carrier; and a restricting protrusion abutting at a distal end thereof against the partition member to support the partition member and restricting the position of the partition member to ensure the formation of the opening. A distal side portion of the restricting protrusion located within the light-emitting region has a tapered shape narrowing with approach toward the partition member.

10 Claims, 11 Drawing Sheets

(56) References Cited

U.S. PATENT DOCUMENTS

| | | | | |
|---|---|---|---|---|
| 8,200,123 | B2 | 6/2012 | Goda et al. | |
| 8,290,401 | B2 | 10/2012 | Tsutsumi | |
| 2006/0188288 | A1 | 8/2006 | Tomiie et al. | |
| 2012/0027451 | A1 * | 2/2012 | Shin | 399/98 |

FOREIGN PATENT DOCUMENTS

| | | | |
|---|---|---|---|
| JP | 2004-240055 | A | 8/2004 |
| JP | 2006-234882 | A | 9/2006 |
| JP | 2006-234883 | A | 9/2006 |
| JP | 2007-187805 | A | 7/2007 |
| JP | 2010-008976 | A | 1/2010 |
| JP | 2010-054700 | A | 3/2010 |
| JP | 2011-043784 | A | 3/2011 |

OTHER PUBLICATIONS

Notice of Rejection mailed by Japan Patent Office on Aug. 12, 2014 for Japanese patent application No. 2014-116559, which is a divisional application of JP 2012-117901.

Notice of Rejection mailed by Japan Patent Office on Aug. 12, 2014 for Japanese patent application No. 2014-116560, which is a divisional application of JP 2012-117901.

* cited by examiner

STATIC ELIMINATING DEVICE AND IMAGE FORMING APPARATUS

INCORPORATION BY REFERENCE

This application claims priority to Japanese Patent Application No. 2012-117901 filed on May 23, 2012, the entire contents of which are incorporated by reference herein.

BACKGROUND

The present disclosure relates to static eliminating device configured to irradiate an image carrier with static eliminating light to statically eliminate the image carrier and electrophotographic image forming apparatuses with the static eliminating device.

Electrophotographic image forming apparatuses are required to reduce the parts cost and the size of the apparatus housing and also required so that a photosensitive drum serving as an image carrier in the image forming apparatus has the effect of reducing the production of a ghost image due to exposure memory on the surface of the photosensitive drum. To reduce the production of a ghost image due to exposure memory, it is necessary to irradiate a region of the photosensitive drum having undergone image transfer with static eliminating light to statically eliminate the surface of the photosensitive drum.

Generally, a static eliminating device is disposed between a drum cleaning device configured to remove deposits, such as residual toner, on the surface of the photosensitive drum and a charging section configured to charge the surface of the photosensitive drum. However, when the image forming speed is increased, the linear speed (peripheral speed) of the photosensitive drum is also increased to significantly shorten the time from static elimination to charging. As a result, trapped carrier (charge) remains in the photosensitive layer on the photosensitive drum, which makes it likely to produce a ghost image due to exposure memory that will degrade the image quality.

To prevent the production of a ghost image due to exposure memory, an image forming apparatus is proposed in which a static eliminating device is disposed upstream of the cleaning device in the rotational direction of the photosensitive drum to secure a time enough to vanish the trapped carrier within the period from static elimination to charging.

The static eliminating device, if disposed upstream of the cleaning device in the rotational direction of the photosensitive drum, is located close downstream of a transfer section. Therefore, untransferred toner having been left untransferred to a paper sheet and toner scattering after the transfer to the paper sheet may adhere to a light-emitting part serving as a static eliminating light source of the static eliminating device. To prevent the adhesion of toner to the light-emitting part, the above image forming apparatus with the static eliminating device disposed upstream of the cleaning device in the rotational direction of the photosensitive drum employs a structure in which a partition member is provided between a paper conveyance path and the static eliminating device and an opening is formed between the partition member and the housing of the static eliminating device to open facing the surface of the photosensitive drum and allow static eliminating light to pass therethrough.

However, in the static eliminating device built in the above image forming apparatus, the space between the partition member and the housing of the static eliminating device, i.e., the opening for passage of the static eliminating light, is restricted by the size (diameter) of the photosensitive drum and the paper conveyance path. Therefore, it is difficult for the opening to secure a sufficient vertical space in the circumferential direction of the photosensitive drum. For this reason, a substrate on which the light-emitting part of the static eliminating device is mounted needs to be disposed in parallel with the outside surface of the housing. In addition, in the above image forming apparatus and its static eliminating device, the partition member is connected (fixed) at the proximal end to the housing but the other end thereof is a free end.

Furthermore, it is conceivable that the static eliminating device is provided with a restricting protrusion disposed between the surface of the photosensitive drum and the substrate and extending toward the partition member in the thickness direction of the substrate. With the use of such a structure including the restricting protrusion, the position of the partition member can be restricted by the restricting protrusion to facilitate the keeping of the opening for passage of static eliminating light. However, static eliminating light becomes likely to be shielded by the restricting protrusion to decrease the amount of static eliminating light passing through the opening. This presents a problem of uneven intensity distribution of static eliminating light along the axial direction of the photosensitive drum.

SUMMARY

A static eliminating device according to one aspect of the present disclosure is a static eliminating device configured to irradiate a charged surface of an image carrier with static eliminating light to statically eliminate the image carrier and includes a housing, a substrate, a light-emitting part, a partition member, and a restricting protrusion.

The substrate is mounted to the housing.

The light-emitting part is mounted on a mounting surface of the substrate and configured to emit the static eliminating light.

The partition member is connected to the housing to cover the substrate and the light-emitting part and face a portion of the housing to which the substrate and the light-emitting part are mounted so that an opening facing the surface of the image carrier is formed in a light-emitting region across which light is delivered from the light-emitting part to the surface of the image carrier.

The restricting protrusion is surrounded by the surface of the image carrier, the substrate, and the light-emitting part, protrudes from the portion of the housing toward the partition member, abuts at a distal end thereof against the partition member to support the partition member, and restricts the position of the partition member to ensure the formation of the opening.

Furthermore, at least a distal side portion of the restricting protrusion located within the light-emitting region in a direction extending from the portion of the housing toward the partition member has a tapered shape narrowing with approach toward the partition member.

DETAILED DESCRIPTION

First Embodiment

Figure 1:
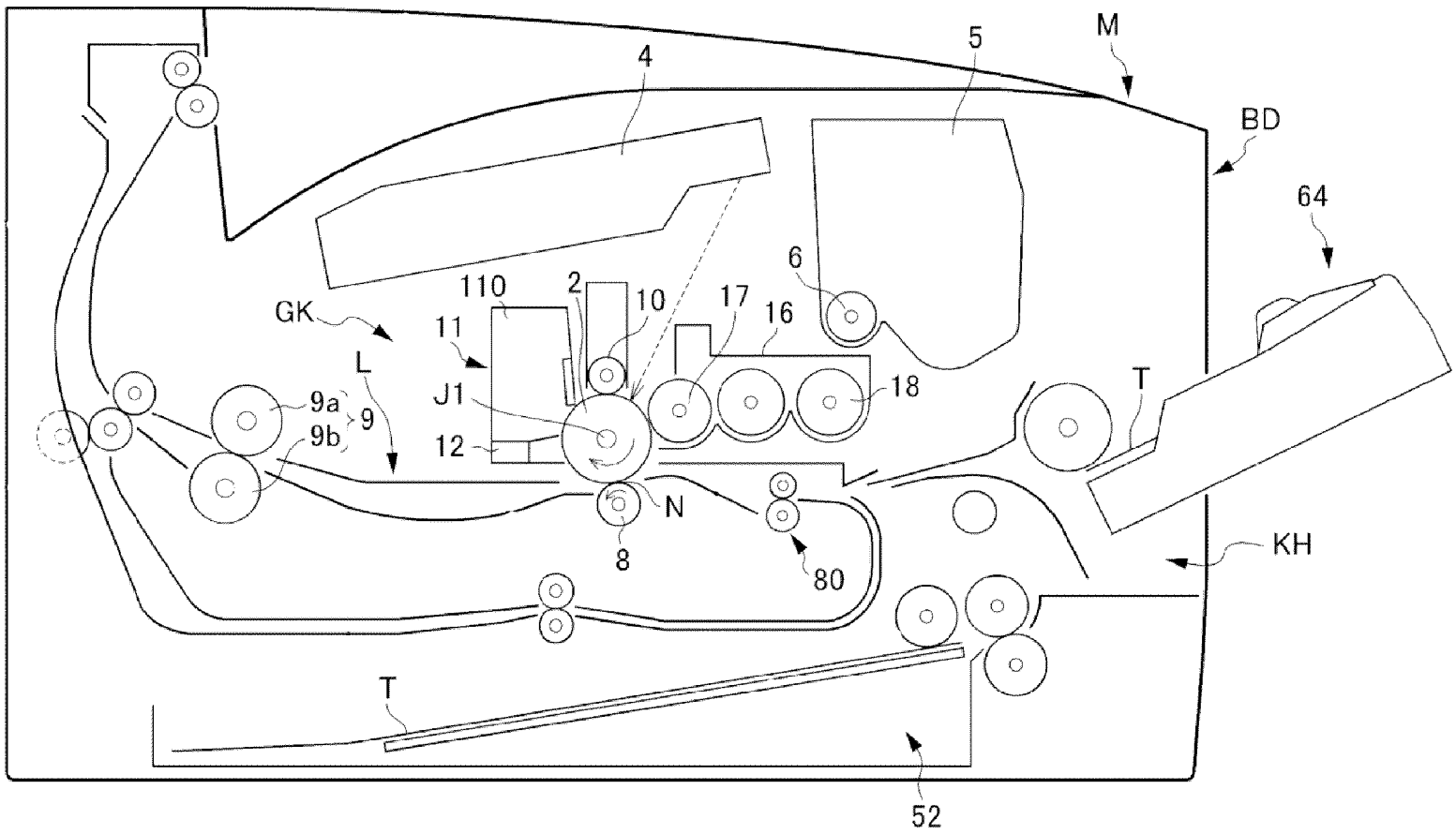
FIG. 1 is a view for illustrating an arrangement of components of a printer 1 in an embodiment of the present disclosure.
Figure 2:
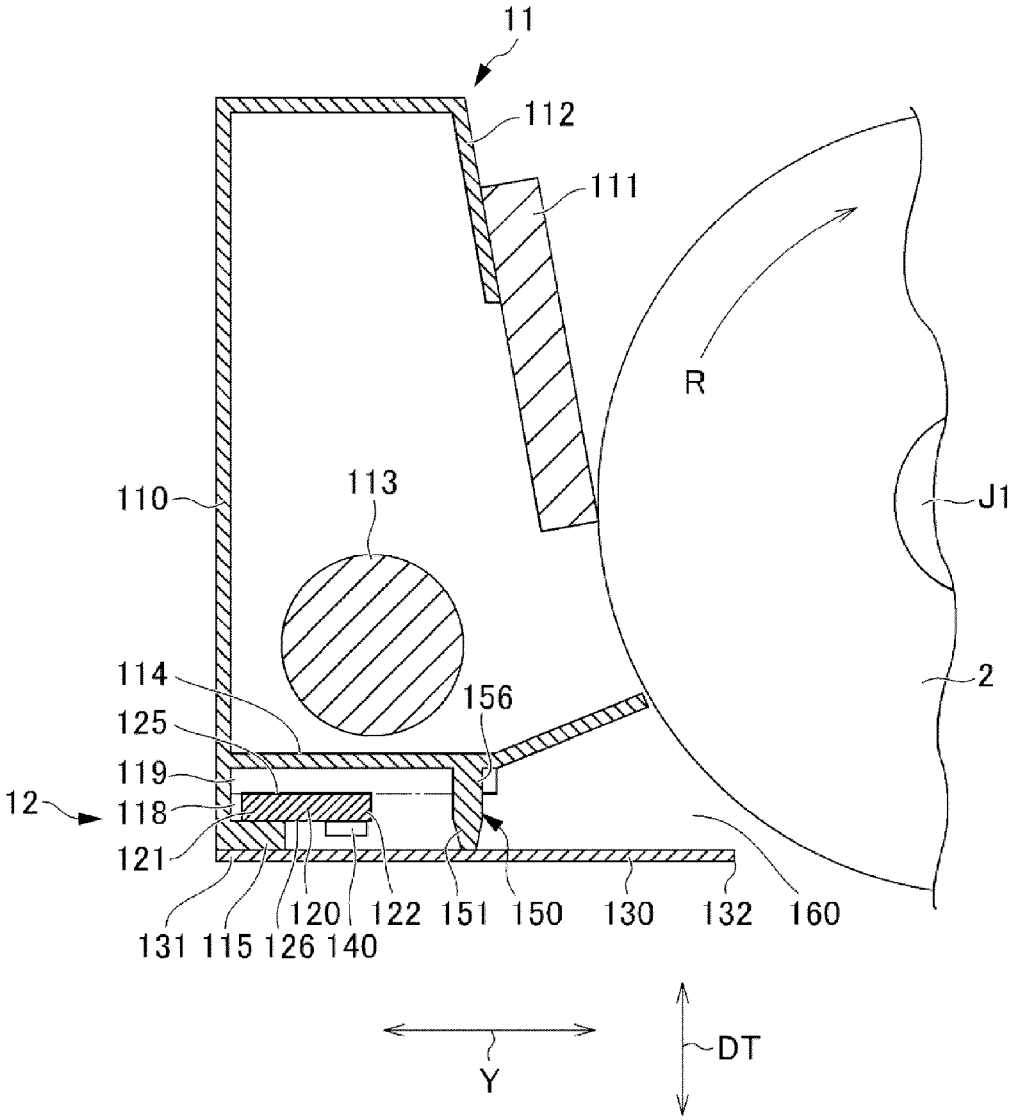
FIG. 2 is a longitudinal sectional view showing a schematic structure of a static eliminating device 12 of a first embodiment built into the printer 1 shown in FIG. 1.

Hereinafter, a description will be given of a first embodiment of the present disclosure with reference to the drawings. First, the description is given of a general structure of a printer 1 in the first embodiment of an image forming apparatus of the present disclosure with reference to FIGS. 1 and 2. FIG. 1 is a view for illustrating an arrangement of components of the printer 1 in this embodiment of the present disclosure. FIG. 2 is a longitudinal sectional view showing a schematic structure of a static eliminating device 12 of the first embodiment built into the printer 1 shown in FIG. 1.

As shown in FIG. 1, the printer 1 serving as the image forming apparatus includes an apparatus main unit M, an image forming section GK configured to form a predetermined toner image on a paper sheet T serving as a recording sheet material for use in image transfer, based on predetermined image data, and a paper feed/discharge section KH configured to feed the paper sheet T to the image forming section GK and discharge the paper sheet T having the toner image formed thereon. The outer shape of the apparatus main unit M is defined by a case body BD serving as the housing.

As shown in FIG. 1, the image forming section GK includes a photosensitive drum 2 serving as the image carrier (a photoreceptor), a charging section 10 configured to electrostatically charge the photosensitive drum 2, a laser scanner unit 4 serving as an exposure section, a developing section 16, a toner cartridge 5, a toner supply section 6, a cleaning device 11, a static eliminating device 12, a transfer roller 8 serving as a transfer section, and a fixing section 9.

As shown in FIG. 1, the paper feed/discharge section KH includes a paper feed cassette 52, a manual paper feed section 64, a conveyance path L for paper sheets T, a resist roller pair 80, and a paper discharge section 50.

The structure of the image forming section GK is described below in detail.

In the image forming section GK, the following operations are performed in order from upstream to downstream along the surface of the photosensitive drum 2: charging of the charging section 10, exposure of the laser scanner unit 4, development of the developing section 16, transfer of the transfer roller 8, static elimination of the static eliminating device 12, and cleaning of the cleaning device 11.

The photosensitive drum 2 is formed of, for example, a cylindrical member having a semiconductor layer of amorphous silicon formed on the surface, and functions as a photoreceptor or an image carrier. The photosensitive drum 2 is disposed rotatably in the direction of the arrow about the axis of a first rotating shaft J1 extending in the direction orthogonal to the direction of conveyance of the paper sheet T on the conveyance path L. An electrostatic latent image can be formed on the surface of the photosensitive drum 2.

The charging section 10 is disposed facing the surface of the photosensitive drum 2. The charging section 10 includes a charging roller and a charge cleaning brush (not shown). The charging roller provided in the charging section 10 uniformly charges the surface of the photosensitive drum 2 negatively (to give a negative polarity) or positively (to give a positive polarity). The charge cleaning brush (not shown) provided in the charging section 10 cleans the surface of the charging roller after charging the photosensitive drum 2.

The laser scanner unit 4 functions as the exposure section and is disposed apart from the surface of the photosensitive drum 2. The laser scanner unit 4 includes an unshown laser source, a polygon mirror, a motor for driving the polygon mirror, and so on.

The laser scanner unit 4 scan-exposes the surface of the photosensitive drum 2 to light based on image data input from an external device, such as a personal computer (PC). By the scan-exposure of the laser scanning unit 4, charge on the exposed portion of the surface of the photosensitive drum 2 is removed. Thus, an electrostatic latent image is formed on the surface of the photosensitive drum 2.

The developing section 16 is disposed facing the surface of the photosensitive drum 2. The developing section 16 causes a monochromatic color (generally black) toner to adhere to the electrostatic latent image formed on the photosensitive drum 2 and thereby forms a monochromatic toner image on the surface of the photosensitive drum 2. The developing section 16 includes a developing roller 17 disposed facing the surface of the photosensitive drum 2, a agitating roller 18 for use in agitating toner, and so on.

The toner cartridge 5 is configured to contain toner to be supplied to the developing section 16.

The toner supply section 6 is provided in association with the toner cartridge 5 and the developing section 16 and configured to supply the toner contained in the toner cartridge 5 to the developing section 16. The toner supply section 6 and the developing section 16 are connected via an unshown toner supply passage.

The transfer roller 8 transfers the toner image developed on the surface of the photosensitive drum 2 to the paper sheet T. An unshown transfer bias applying section applies to the transfer roller 8 a transfer bias for transferring the toner image formed on the photosensitive drum 2 to the paper sheet T.

The transfer roller 8 abuts and separates from the photosensitive drum 2. Specifically, the transfer roller 8 is configured to be movable between an abutment position in which it is abutted against the photosensitive drum 2 and a separated position in which it is separated from the photosensitive drum 2. More specifically, the transfer roller 8 is located in the abutment position during transfer of the toner image developed on the photosensitive drum 2 to the paper sheet 7 or otherwise located in the separated position.

The paper sheet T being conveyed along the conveyance path L is nipped between the photosensitive drum 2 and the transfer roller 8. The nipped paper sheet T is pressed against the surface of the photosensitive drum 2. Thus, a transfer nip N is formed between the photosensitive drum 2 and the transfer roller 8. In the transfer nip N, the toner image developed on the photosensitive drum 2 is transferred to the paper sheet T.

The static eliminating device 12 is disposed facing the surface of the photosensitive drum 2. The static eliminating device 12 irradiates the surface of the photosensitive drum 2 after the transfer with static eliminating light to statically eliminate (remove residual charge from) the surface of the photosensitive drum 2.

The details of the static eliminating device 12 will be described later.

The cleaning device 11 is disposed facing the surface of the photosensitive drum 2. The cleaning device 11 removes deposits, such as residual toner and paper powder, remaining on the surface of the photosensitive drum 2. In addition, the cleaning device 11 conveys the removed deposits to a designated recovery mechanism to allow the recovery mechanism to recover the deposits.

As shown in FIG. 2, the cleaning device 11 includes a housing 110, a cleaning blade 111, a blade holder 112, and a collected toner discharging screw 113.

The fixing section 9 melts and presses the toner forming the toner image transferred to the paper sheet T to fix it on the paper sheet T. The fixing section 9 includes a heat rotor 9*a* capable of being heated by a heater; and a pressure rotor 9*b* capable of being pressed against the heat rotor 9*a*. The heat rotor 9*a* and the pressure rotor 9*b* nip the paper sheet T having the toner image transferred thereto and convey it while heating and pressing it. When the paper sheet T is conveyed as it is nipped between the heat rotor 9*a* and the pressure rotor 9*b*, the toner transferred to the paper sheet T is melted and pressed, resulting in fixation on the paper sheet T.

To sum up, the printer 1 described so far includes: the photosensitive drum 2; the charging section 10 disposed facing and in contact with the surface of the photosensitive drum 2 and configured to charge the surface of the photosensitive drum 2; the laser scanner unit 4 configured to form an electrostatic latent image on the surface of the photosensitive drum 2 charged by the charging section 10; the developing section 16 allowing toner to adhere to the electrostatic latent image formed by the laser scanner unit 4 to thereby form a toner image on the surface of the photosensitive drum 2; the transfer roller 8 configured to transfer the toner image formed on the surface of the photosensitive drum 2 by the developing section 16 directly or indirectly to a paper sheet T; the static eliminating device 12 (which will be described later in detail) configured to irradiate the surface of the photosensitive drum 2 after the running of the transfer roller 8 with static eliminating light to statically eliminate the surface of the photosensitive drum 2 (remove charge thereon) after the transfer; and the cleaning device 11 configured to remove deposits, such as residual toner, remaining on the surface of the photosensitive drum 2.

Figure 3:
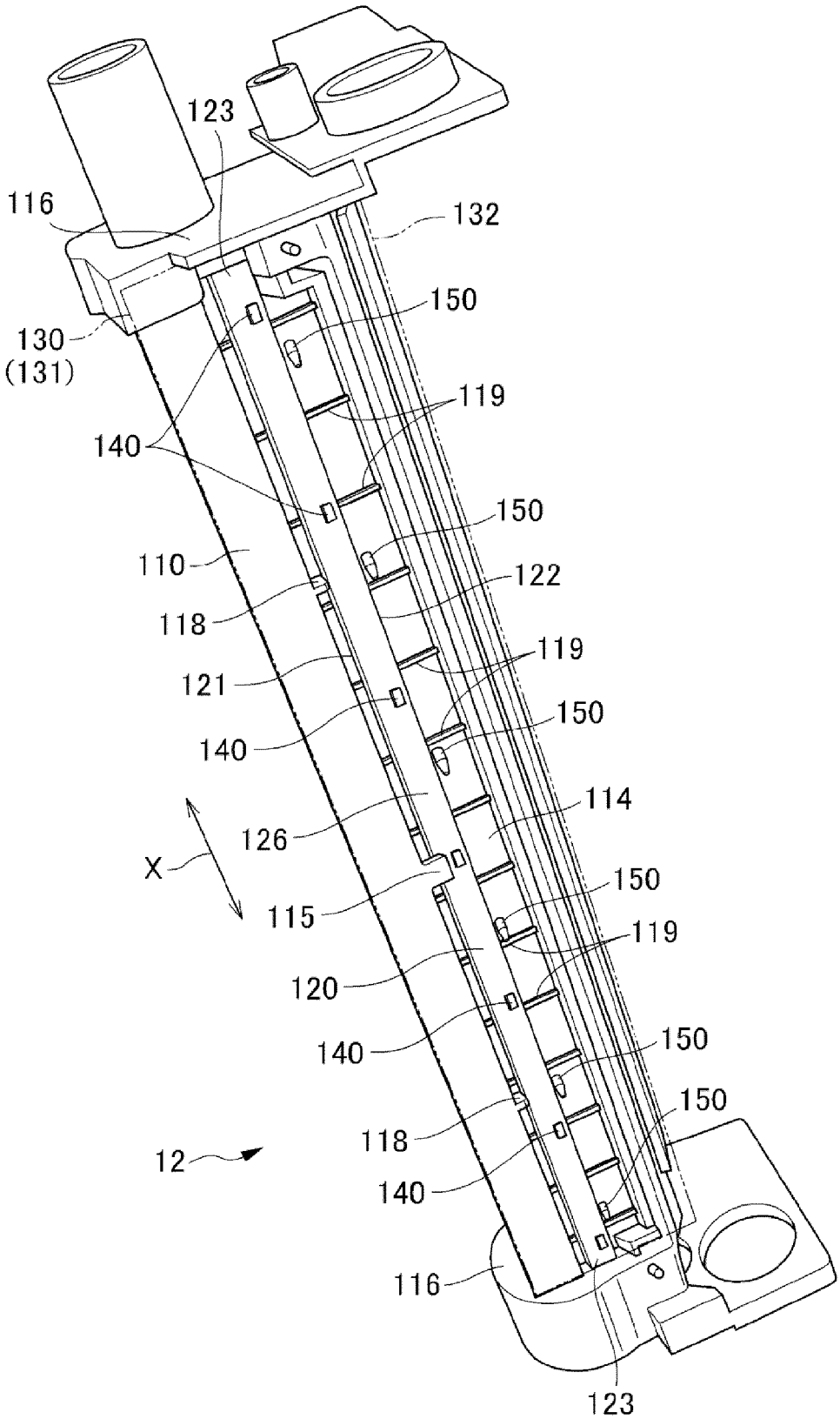
FIG. 3 is a perspective view of the static eliminating device 12 seen from below.
Figure 4:
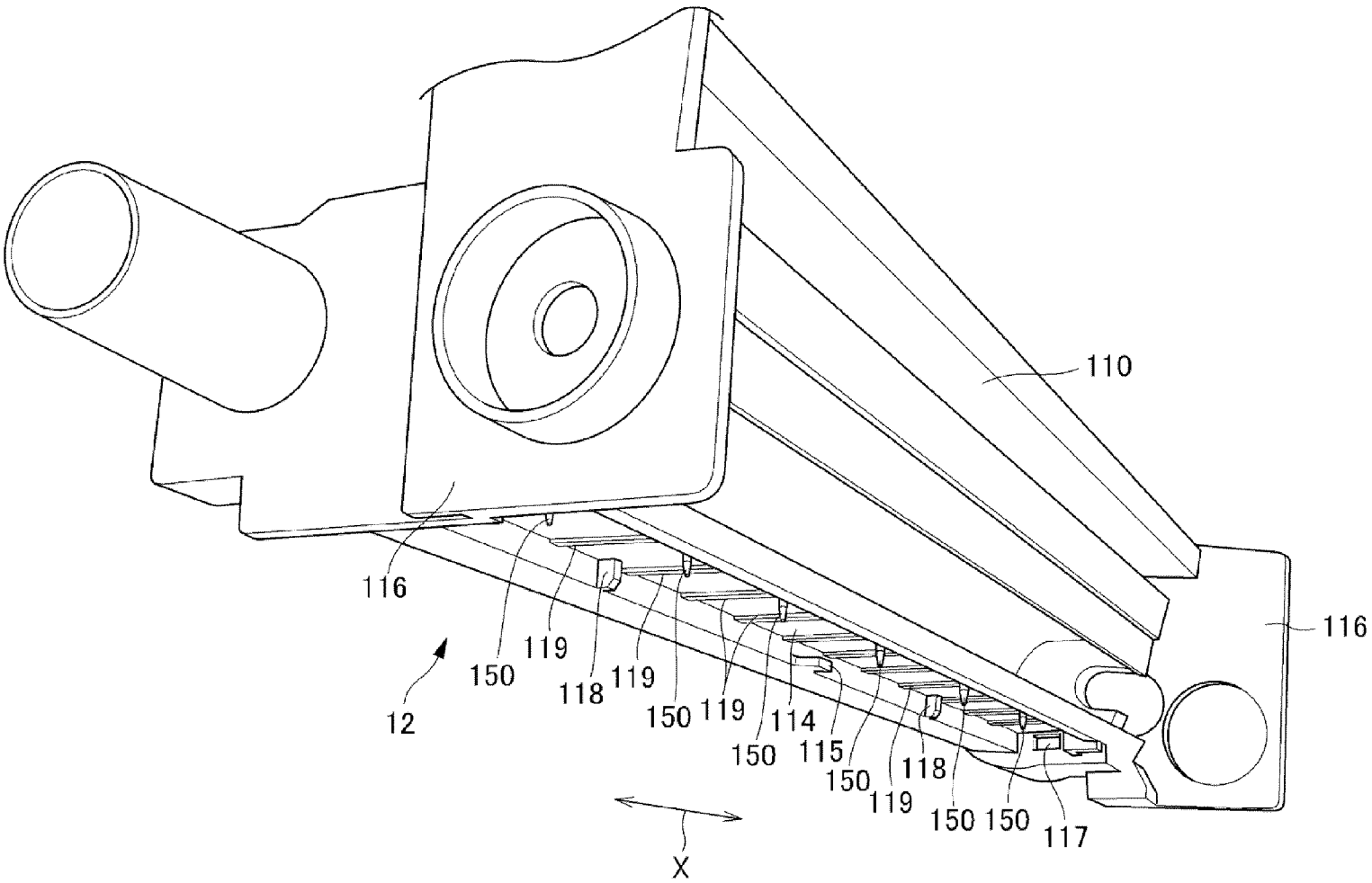
FIG. 4 is a perspective view of the static eliminating device 12 seen from below, in which a substrate 120 and a partition member 130 have been removed.
Figure 5:
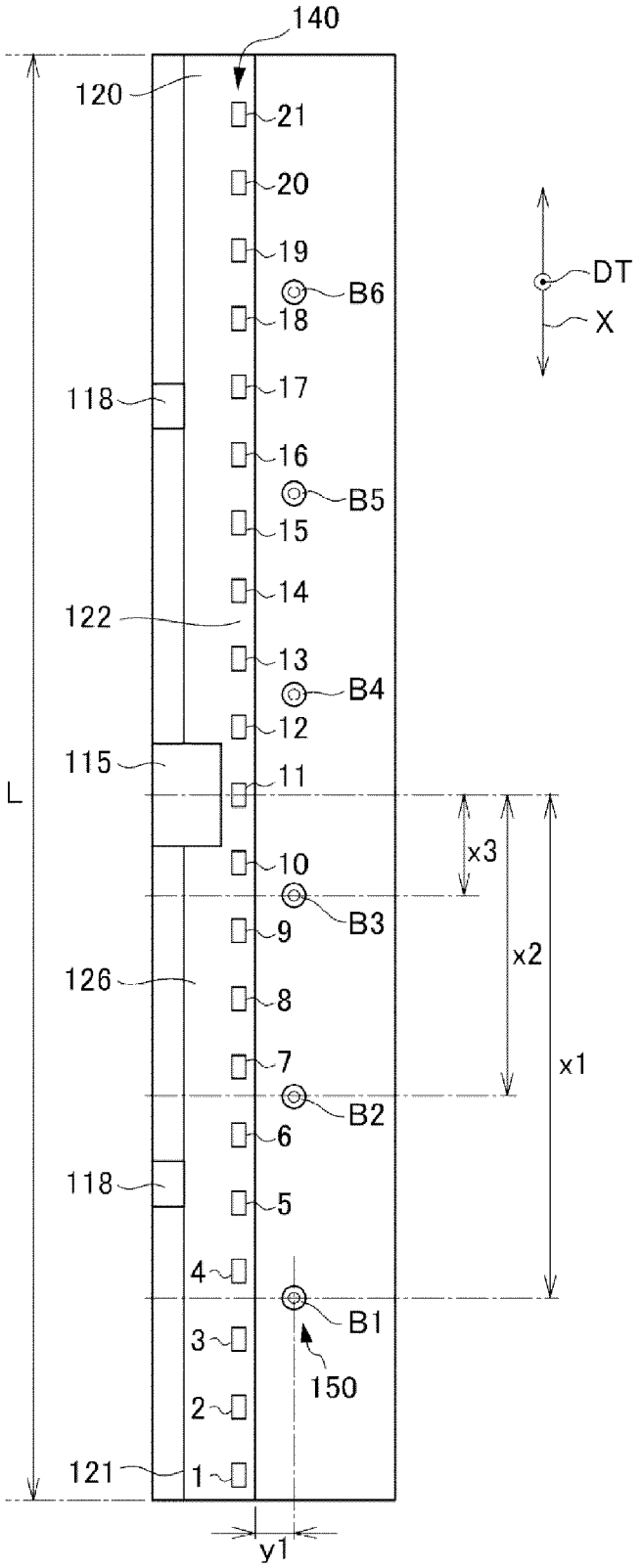
FIG. 5 is a bottom view of a relevant portion of the static eliminating device 12 of the first embodiment.
Figure 6:
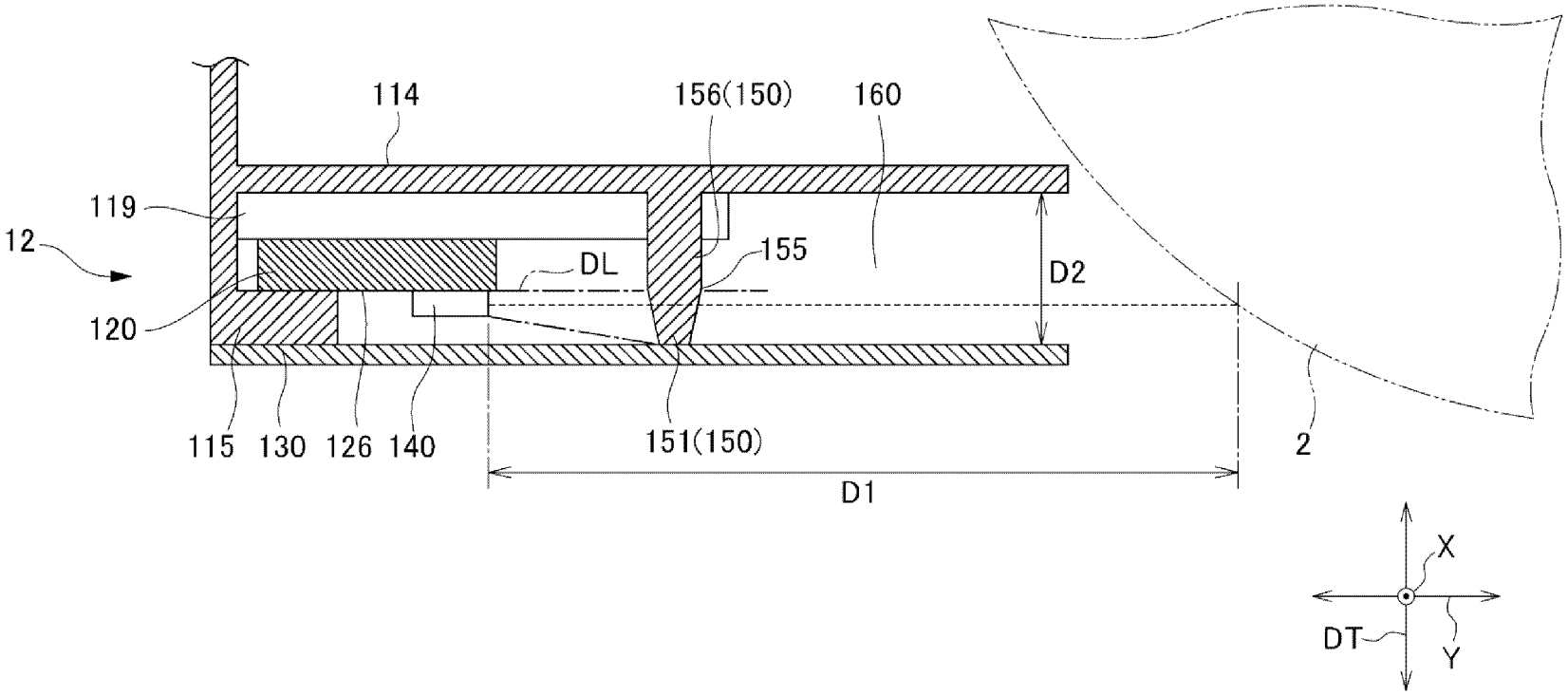
FIG. 6 is a longitudinal sectional view of a relevant portion of the static eliminating device 12 of the first embodiment.
Figure 7:
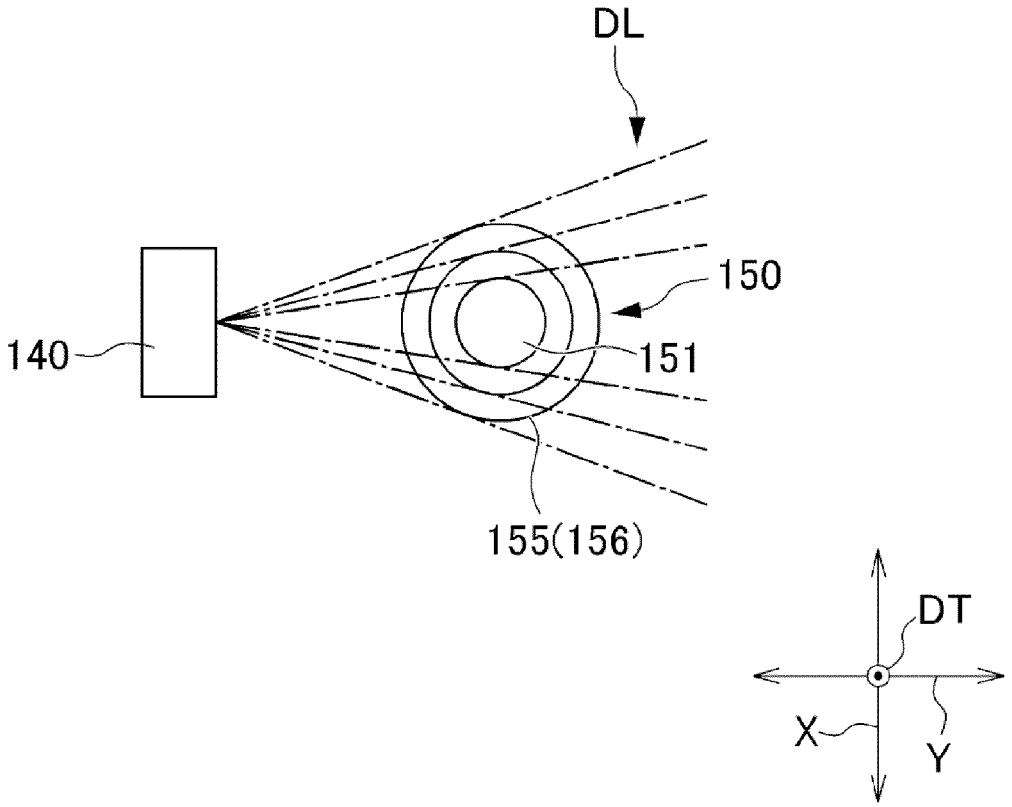
FIG. 7 is a schematic view showing a state that static eliminating light DL is shielded by a restricting protrusion 150 in the first embodiment.

Next, the details of the static eliminating device 12 of the first embodiment are described with reference to FIGS. 2 to 7. FIG. 3 is a perspective view of the static eliminating device 12 seen from below. FIG. 4 is a perspective view of the static eliminating device 12 seen from below, in which a substrate 120 and a partition member 130 have been removed. FIG. 5 is a bottom view of a relevant portion of the static eliminating device 12 of the first embodiment. FIG. 6 is a longitudinal sectional view of a relevant portion of the static eliminating device 12 of the first embodiment. FIG. 7 is a schematic view showing a state that static eliminating light DL is shielded by a restricting protrusion 150 in the first embodiment.

The static eliminating device 12 of the first embodiment is disposed, as shown in FIG. 2, upstream of the cleaning device 11 in the rotational direction R of the photosensitive drum 2. As shown in FIG. 2, the static eliminating device 12 includes: a housing 110 also serving as the housing for the cleaning device 11; a substrate 120 connected to the housing 110; a plurality of LEDs 10 serving as the light-emitting parts capable of emitting static eliminating light DL (see FIG. 7); a first end engagement part 115; a partition member 130; and a plurality of restricting protrusions 150.

As shown in FIGS. 3 to 5, the substrate 120 has a longitudinal direction X extending along the axial direction of the first rotating shaft J1 of the photosensitive drum 2. The plurality of LEDs 140 are mounted in a row at intervals equally spaced along the longitudinal direction X of the substrate 120 on a mounting surface 126 of the substrate 120 (on which the LEDs 140 are to be mounted). The LEDs 140 are side view LEDs. The LEDs 140 emit static eliminating light DL (see FIG. 7) along a transversely extending direction (along the plane direction) Y of the substrate 120 to irradiate the surface of the photosensitive drum 2 with the emitted static eliminating light. Although the number of LEDs 140 actually provided is 21 as shown in an example of FIG. 5, only seven are shown in this embodiment for simplicity of drawing and explanation.

As shown in FIGS. 2 to 5, the first end engagement part 115 is provided at the lower end of the housing 110 and extends in the form of a tongue from under the middle of the substrate 120 in the longitudinal direction X thereof toward the photosensitive drum 2. The first end engagement part 115 is located at a position corresponding to the middle of the row of restricting protrusions 150 to be described later.

The housing 110 includes a plurality of ribs 119, a plurality of abutment protrusions 118, a pair of side plates 116, and a pair of third end engagement parts 117. The plurality of ribs 119 are formed at intervals in the longitudinal direction X of the substrate 120. The ribs 119 reduce the contact area between a non-mounting surface 125 of the substrate 120 (a surface thereof opposite to the mounting surface 126 on which the LEDs 140 are mounted) and a bottom plate 114 of the housing 110.

The first end engagement part 115 engages from below against a first end 121 of the substrate 120 opposite to the photosensitive drum 2 to sandwich the first end 121 between itself and the ribs 119. The plurality of abutment protrusions 118 are provided to avoid that the substrate 120 engaged between the first end engagement part 115 and the ribs 119 is displaced in the direction away from the photosensitive drum 2. The plurality of abutment protrusions 118 are formed to extend in the direction orthogonal to the longitudinal direction X of the substrate 120. Although two abutment protrusions 118 are shown in the drawings, three or more abutment protrusions may be provided.

As shown in FIGS. 3 and 4, the pair of side plates 116 are disposed at both ends of the substrate 120 in the longitudinal direction X and face each other. The pair of third end engagement parts 117 are elongate holes and are formed, one in each of the pair of side plates 116. The pair of third end engagement parts 117 engage on a pair of third ends 123 of the substrate 120 which are both ends thereof in the longitudinal direction X. By the engagement of the pair of third ends 123 of the substrate 120 into the pair of third end engagement parts 117 of the housing 110, the substrate 120 is supported as a beam to the housing 110.

The partition member 130 prevents toner from adhering to the LEDs 140. The partition member 130 is made of low-cost, low-rigidity resin, has substantially the same length as the substrate 120 in the longitudinal direction X of the substrate 120, and is disposed with the substrate 120 between itself and the bottom plate 114 of the housing 110. The partition member 130 is fixed and connected at its proximal end 131 to the lower end of the housing 110. The proximal end 131 is an end of the substrate 120 farthest away from the photosensitive drum 2 in a proximal and distal direction Y relative to the photosensitive drum 2. Thus, an opening 160 facing and opening toward the surface of the photosensitive drum 2 is formed between the bottom plate 114 of the housing 110 and the partition member 130 to allow passage of static eliminating light.

The plurality of (six in this embodiment) restricting protrusions 150 are provided between the surface of the photosensitive drum 2 and a second end 122 of the substrate 120 (an end thereof opposite to the first end 121). The plurality of restricting protrusions 150 are aligned in a row along the axial direction of the first rotating shaft J1 of the photosensitive drum 2, i.e., the longitudinal direction X of the substrate 120. The plurality of restricting protrusions 150 protrude from the bottom plate 114 of the housing 110 toward the partition member 130 in the thickness direction DT of the substrate 120. The plurality of restricting protrusions 150 abut from above against an intermediate portion of the partition member 130 in the transversely extending direction Y of the substrate 120 to keep the opening 160 for the passage of static eliminating light. Thus, the position of the partition member 130 is restricted. More specifically, a free end 132 of the partition member 130 is restricted from moving close to the bottom plate 114 of the housing 110, resulting in securement (keeping) of the opening 160.

As shown in FIGS. 3 to 5, the direction of alignment of the plurality of (six) restricting protrusions 150 and the direction of alignment of the plurality of (seven) LEDs 140 are parallel with the axial direction of the first rotating shaft J1 of the photosensitive drum 2. The plurality of (six) restricting protrusions 150 and the plurality of (seven) LEDs 140 are staggered in the longitudinal direction X of the substrate 120.

As shown in FIGS. 6 and 7, the restricting protrusions 150 protrude toward the partition member 130 in the thickness direction DT of the substrate 120. Each restricting protrusion 150 includes a proximal side portion 156 and a distal side portion 151. The proximal side portion 156 and the distal side portion 151 are integrally formed. The reference 155 denotes the boundary between the proximal side portion 156 and the distal side portion 151.

The proximal side portion 156 is a portion of the restricting protrusion 150 close to the proximal end thereof and farther away from the partition member 130 in the thickness direction DT of the substrate 120 (closer to the bottom plate 114 of the housing 110) than the mounting surface 126. The proximal side portion 156 has a constant diameter (cross-sectional area) and, more specifically, has a cylindrical shape. The cross-sectional area of the proximal side portion 156 is, for example, 1.7 to 12 $mm^2$. The length of the proximal side portion 156 is, for example, 1 to 3 mm.

The expression "constant diameter" not necessarily means a strictly constant diameter and may include shapes that can be considered to have a substantially constant diameter (in which the ratio of minimum diameter to maximum diameter is 90% or more).

The distal side portion 151 is a portion of the restricting protrusion 150 close to the distal end thereof and closer to the partition member 130 in the thickness direction DT of the substrate 120 than the mounting surface 126. The distal side portion 151 is tapered toward the partition member 130 and, more specifically, has the shape of a circular truncated cone. The area of the circle at the distal end of the distal side portion 151 is, for example, 0.3 to 3 $mm^2$. The length of the distal side portion 151 is, for example, 1 to 3 mm.

For example, if the circle of the lower base of the distal side portion 151 having the shape of a circular truncated cone (i.e., the circle having a larger area equivalent to the cross-sectional circle of the proximal side portion 156) is 1 mm in radius and the circle of the upper base of the distal side portion 151 (the circle having a smaller area) is 0.5 mm in radius, the radius R (mm) of any cross-sectional circle of the distal side portion 151 can be expressed as $R=h/4+1$ where h represents the height (mm) from the lower base.

The circular truncated cone is not limited to a fully circular truncated cone and includes any nearly circular truncated cone that can be considered as a substantially circular truncated cone (for example, a truncated pyramid having slightly rounded edges).

The static eliminating device 12 of this embodiment described so far produces, for example, the following effects.

The static eliminating device 12 of this embodiment includes: the LEDs 140 mounted on the mounting surface 126 of the substrate 120 and serving as the light-emitting parts configured to emit static eliminating light DL; the partition member 130 connected at its proximal end to the housing 110 to form the opening 160 facing and opening toward the surface of the photosensitive drum 2; and the restricting protrusions 150 protruding toward the partition member 130 in the thickness direction DT of the substrate 120 and restricting the position of the partition member 130 to secure the opening 160. The distal side portions 151 of the restricting protrusions 150 closer to the partition member 130 in the thickness direction DT of the substrate 120 than the mounting surface 126 narrow with approach toward the partition member 130.

Therefore, even if the static eliminating device 12 is disposed upstream of the cleaning device 11 in the rotational direction D of the photosensitive drum 2 and close downstream of the transfer section, the partition member 130 can prevent adhesion of untransferred toner and toner scattering after the transfer to the paper or the like to the LEDs 140 of the static eliminating device 12 to protect the static eliminating device 12 from scattering toner.

Furthermore, since the plurality of restricting protrusions 150 can restrict a portion of the partition member 130 close to the free end 132 from moving close to the housing 110 and thus keep the opening 160 formed between the housing 110 and the partition member 130. Thus, it can be prevented that the intensity of static eliminating light emitted by the LEDs 140 and irradiating the photosensitive drum 2 is reduced.

Moreover, the static eliminating device 12 of this embodiment can make each restricting protrusion 150 less shield the static eliminating light DL and thus minimize the reduction of amount of static eliminating light DL passing over the restricting protrusion 150. As a result, the intensity distribution of static eliminating light can be made more even.

Figure 8:
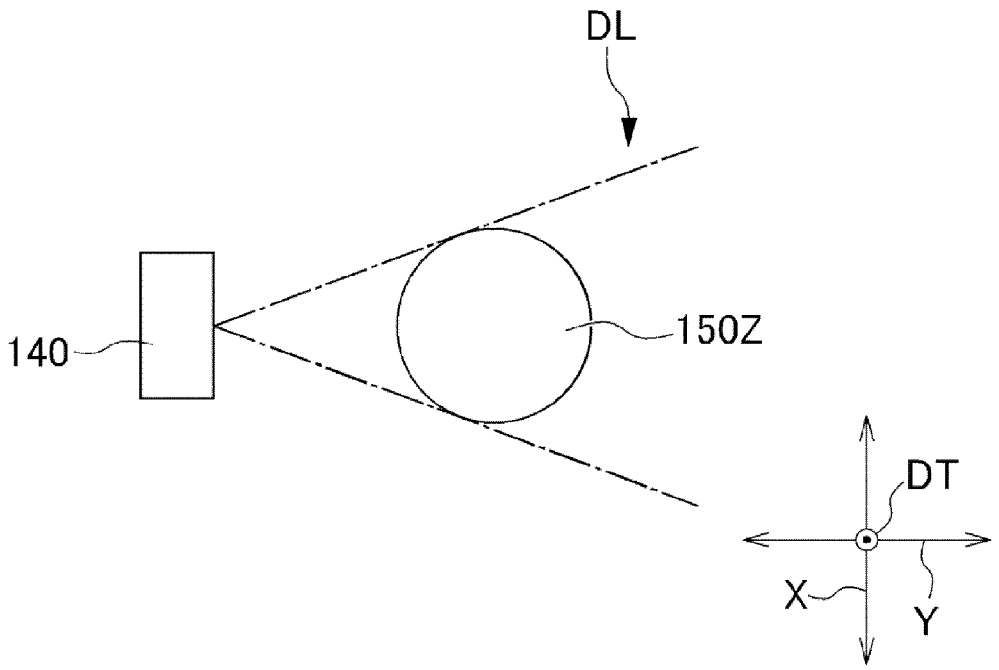
FIG. 8 is a schematic view showing a state that static eliminating light DL is shielded by a restricting protrusion 150Z in a conventional example.

FIG. 8 is a schematic view showing a state that static eliminating light DL is shielded by a restricting protrusion 150Z in a conventional example. As compared to the restricting protrusion 150Z (having a constant cross-sectional shape) in the conventional example shown in FIG. 8, it can be seen that the restricting protrusion 150 in the first embodiment shown in FIG. 7 less shields the static eliminating light DL.

Furthermore, in the static eliminating device 12 of this embodiment, the distal side portion 151 has the shape of an approximately circular truncated cone. Therefore, the distal side portion 151 can be easily formed. In addition, since the abutment surface (abutment circle) of the distal side portion 151 against the partition member 130 is formed at the distal end (upper base) of the distal side portion 151, this makes it possible to more certainly restrict the position of the partition member 130 (keep the opening 160).

Moreover, in the static eliminating device 12 of this embodiment, the proximal side portion 156 has a substantially constant diameter. The proximal side portion 156 generally does not shield the static eliminating light DL and therefore need not be reduced in diameter. Hence, since the proximal side portion 156 has a substantially constant diameter, the strength of the proximal side portion 156 can be sufficiently secured.

Furthermore, in the static eliminating device 12 of this embodiment, the proximal side portion 156 has an approximately cylindrical shape. Therefore, the proximal side portion 156 can be easily formed.

Second Embodiment

Figure 9:
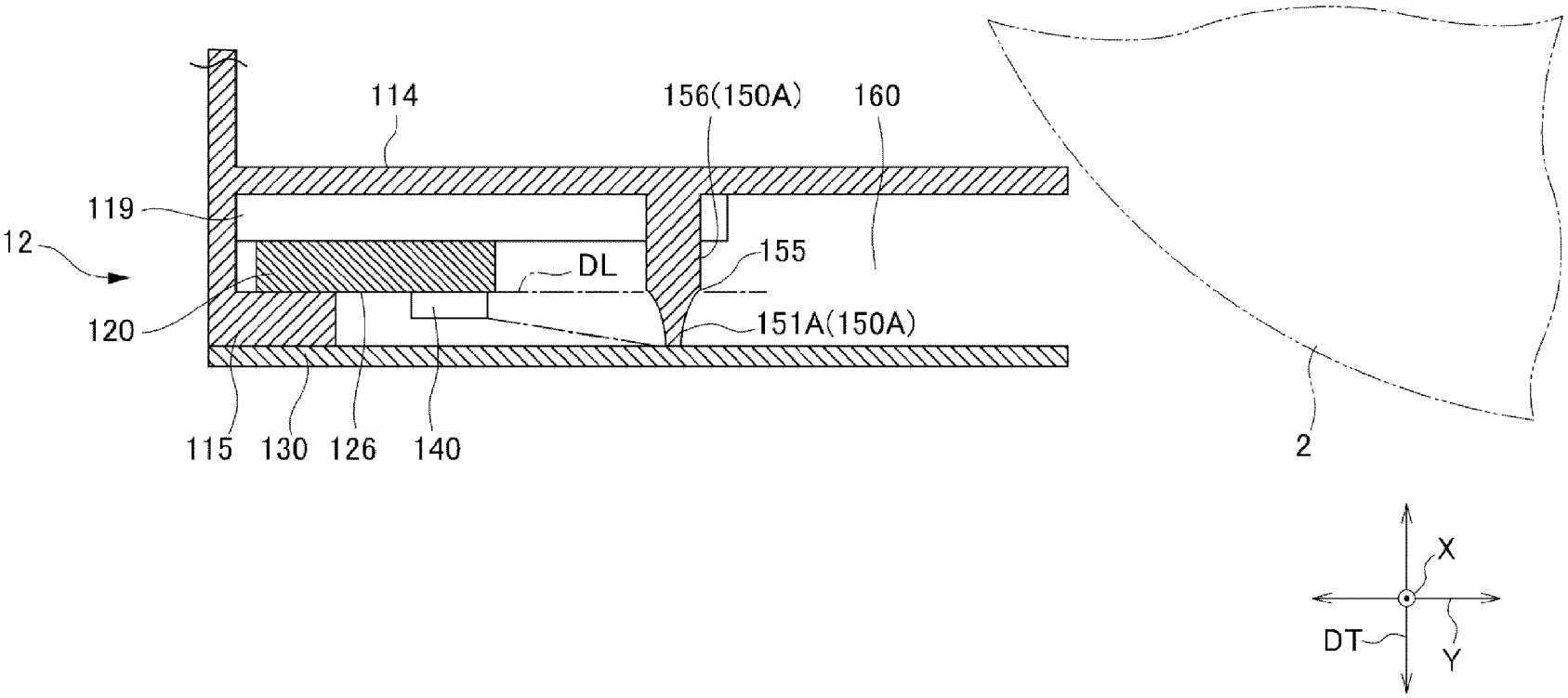
FIG. 9 is a longitudinal sectional view of a relevant portion of a static eliminating device 12 of a second embodiment.
Figure 10:
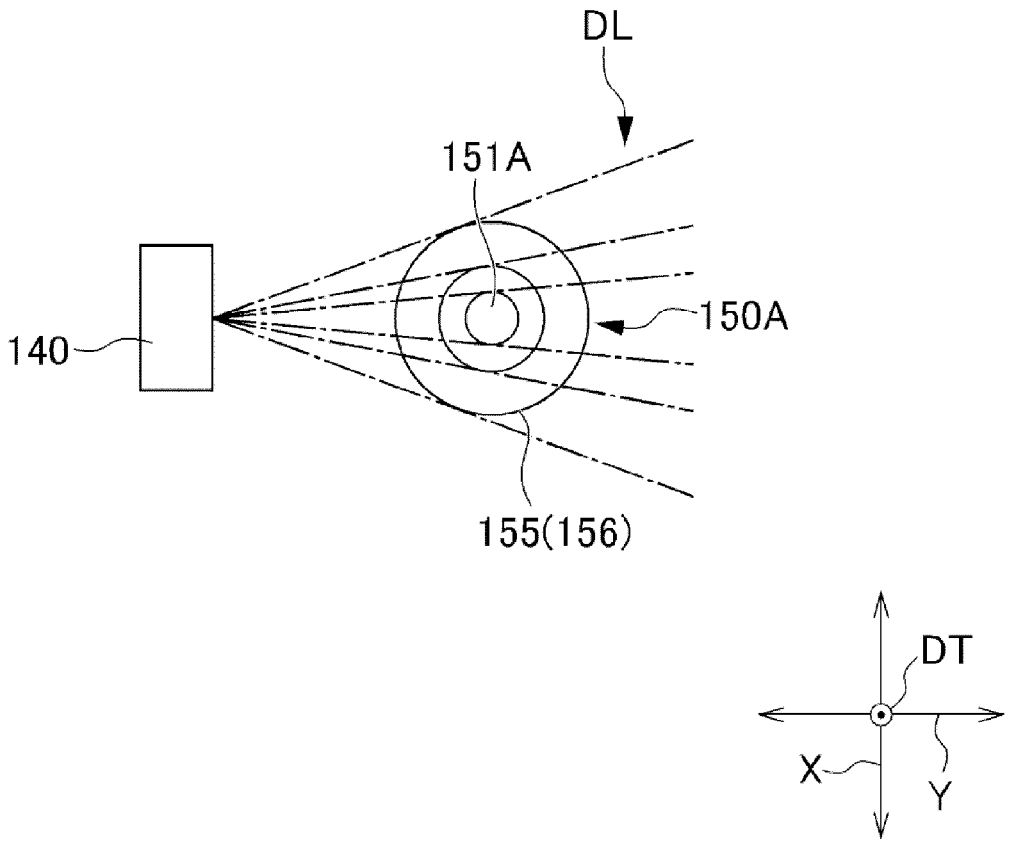
FIG. 10 is a schematic view showing a state that static eliminating light DL is shielded by a restricting protrusion 150A in the second embodiment.

Next, a description will be given of restricting protrusions 150A according to a second embodiment with reference to the drawings. In the description of the second embodiment, the same elements as those in the first embodiment are designated by the same references and further explanation thereof will be accordingly omitted or simplified. FIG. 9 is a longitudinal sectional view of a relevant portion of a static eliminating device 12 of the second embodiment. FIG. 10 is a schematic view showing a state that static eliminating light DL is shielded by a restricting protrusion 150A in the second embodiment.

As shown in FIGS. 9 and 10, the restricting protrusion 150A in the second embodiment is different from the restricting protrusion 150 in the first embodiment, mainly in the manner of reduction of the cross-sectional area of the distal side portion 151A.

In the second embodiment, the distal side portion 151A has a shape in which the cross-sectional area approximately exponentially decreases toward the distal end. The expression "approximately exponentially" may refer to a shape based strictly on an exponential function or a shape that is not based strictly on an exponential function but can be considered to be based on the exponential function. A typical "shape in which the cross-sectional area approximately exponentially decreases" is a shape curved convexly in the direction opposite to the direction of protrusion of the restricting protrusion 150A (in the direction toward the proximal end). The curved shape of the distal side portion 151A shown in FIG. 9 is located more inward (closer to the axis of the restricting protrusion 150A) than the circular truncated cone shape of the distal side portion 151 shown in FIG. 6.

For example, if the circle of the lower base of the distal side portion 151A having a cross-sectional area approximately exponentially decreasing toward the distal end (i.e., the circle having a larger area equivalent to the cross-sectional circle of the proximal side portion 156) is 1 mm in radius and the circle of the upper base of the distal side portion 151A (the circle having a smaller area) is 0.5 mm in radius, the radius R (mm) of any cross-sectional circle of the distal side portion 151A can be expressed as $R=0.6*\exp(-0.89588*h)+0.4$ where h represents the height (mm) from the lower base.

The static eliminating device 12 of the second embodiment produces, in addition to the effects in the first embodiment, the following effect.

In this embodiment, the distal side portion 151A has a shape in which the cross-sectional area approximately exponentially decreases toward the distal end. Therefore, as compared to the circular truncated cone shape of the distal side portion 151 shown in FIG. 6, the cross-sectional area of the distal side portion 151A sharply decreases toward the distal end. Hence, as compared to the distal side portion 151 in the shape of a circular truncated cone shown in FIG. 6, the distal side portion 151A can enhance the effect of making the restricting protrusion 150A less shield the static eliminating light DL. In addition, the distal side portion 151 A can more effectively minimize the reduction of amount of static eliminating light DL passing over the restricting protrusion 150A.

EXAMPLES

Next, a description will be given of examples of the present disclosure with reference to FIGS. 5 and 6. As shown in FIG. 5, in static eliminating device 12 of the examples, the number of LEDs 140 provided therein is 21 as designated at 1 to 21. The LED 140(11), the middle one of the 21 LEDs, is located in the middle of the substrate 120 in the longitudinal direction X. The positions of the 21 LEDs 140 from the LED 140(1) to the LED 140(21) along the longitudinal direction X of the substrate 120 are as shown in TABLE 1 below.

TABLE 1

| LED No. | Position in Direction X (mm) |
|---|---|
| 1 | −110 |
| 2 | −101 |
| 3 | −89 |
| 4 | −78 |
| 5 | −67 |
| 6 | −56 |
| 7 | −44 |
| 8 | −33 |
| 9 | −22 |
| 10 | −11 |
| 11 | 0 |
| 12 | 11 |
| 13 | 22 |
| 14 | 33 |
| 15 | 44 |
| 16 | 56 |
| 17 | 67 |
| 18 | 78 |
| 19 | 89 |
| 20 | 101 |
| 21 | 110 |

The number of restricting protrusions 150 provided is six as designated at B1 to B6. The distances from the midpoint of the substrate 120 in the longitudinal direction X to the centers of the restricting protrusions 150(B1) to 150(B6) are represented by x1 to x6, respectively. The distances from the second end 122 of the substrate 120 to the centers of the restricting protrusions 150(B1) to 150(B6) are represented by y1 to y6, respectively. In FIGS. 5, x4 to x6 and y2 to y6 are not given. The distances x1 to x6 of the restricting protrusions 150(B1) to 150(B6) are as shown in TABLE 2 below. The distances y1 to y6 of all the restricting protrusions 150 are the same and each is 2.473 mm.

TABLE 2

| Restricting Projection No. | x n | Distance x from Origin 0 |
|---|---|---|
| B 1 | x 1 | −83.5 |
| B 2 | x 2 | −50.0 |
| B 3 | x 3 | −16.5 |
| B 4 | x 4 | 16.5 |
| B 5 | x 5 | 50.0 |
| B 6 | x 6 | 83.5 |

Prepared as the restricting protrusions were restricting protrusions 150 in Example 1, restricting protrusions 150A in Example 2, and restricting protrusions 150Z in Comparative Example.

The restricting protrusions 150 in Example 1 are those shown as the first embodiment in FIGS. 6 and 7, wherein the circle of the lower base of the distal side portion 151 (i.e., the circle having a larger area equivalent to the cross-sectional circle of the proximal side portion 156) is 1 mm in radius and the circle of the upper base of the distal side portion 151 (the circle having a smaller area) is 0.5 mm in radius.

The restricting protrusions 150A in Example 2 are those shown as the second embodiment in FIGS. 9 and 10, wherein the circle of the lower base of the distal side portion 151A (i.e., the circle having a larger area equivalent to the cross-sectional circle of the proximal side portion 156) is 1 mm in radius and the circle of the upper base of the distal side portion 151A (the circle having a smaller area) is 0.5 mm in radius.

The restricting protrusions 150Z in Comparative Example are those shown as the conventional example in FIG. 8, wherein the cross-sectional circle is 1 mm in radius.

As shown in FIG. 5, the distance L between the support positions of the pair of third ends 123 of the substrate 120 is 240 mm. As shown in FIG. 6, the distance D1 from each LED 140 to the surface of the photosensitive drum 2 is 18.6 mm. The width D2 of the opening 160 in the vertical direction (the thickness direction of the partition member 130) is 2.5 mm. LEDs having a full width of 120° at half maximum was used as the LEDs 140.

Figure 11:
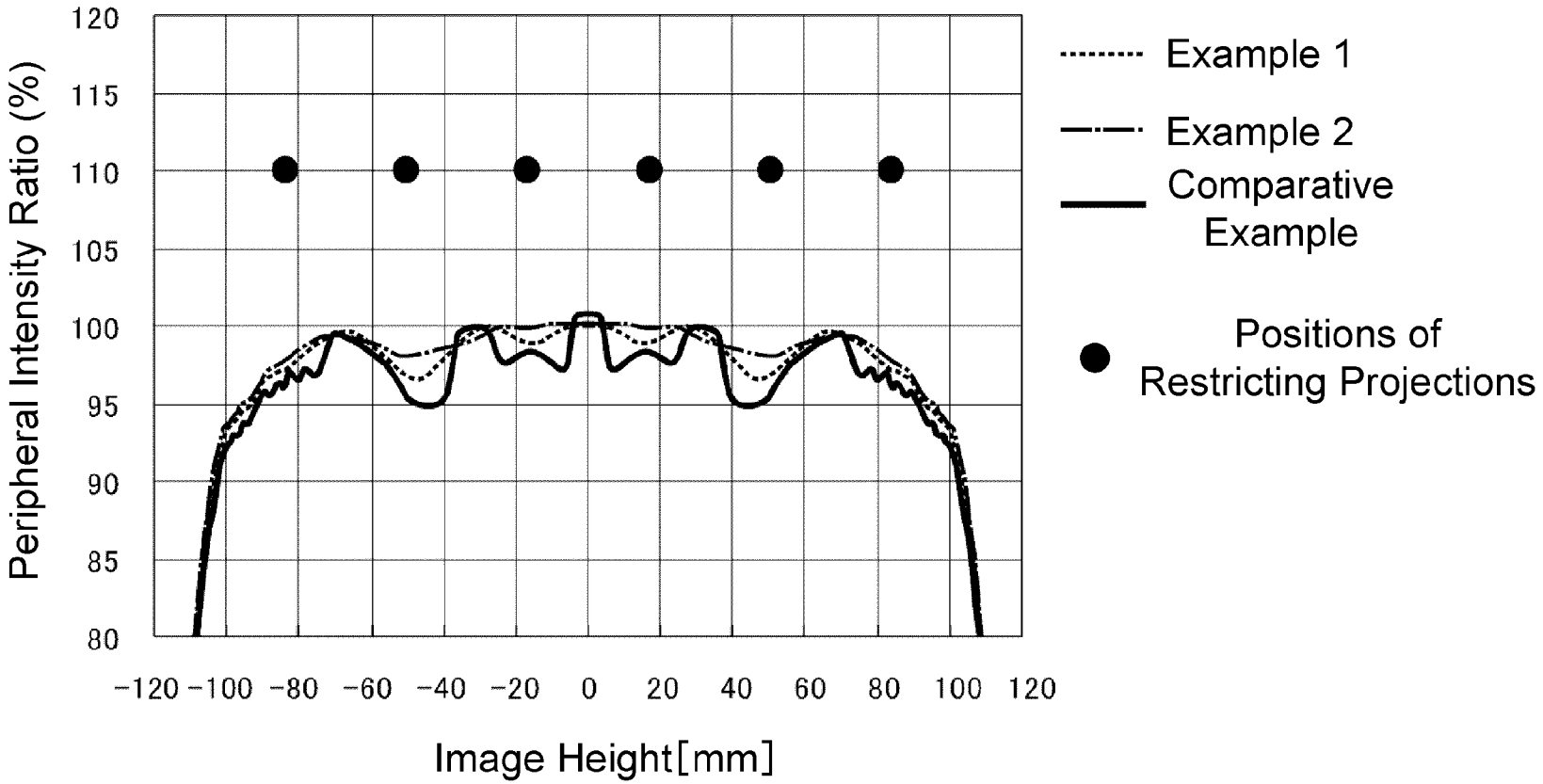
FIG. 11 is a graph showing the respective intensity distributions of static eliminating light (peripheral intensity ratios) in Examples 1 and 2 and Comparative Example.

FIG. 11 is a graph showing the respective intensity distributions of static eliminating light (peripheral intensity ratios) in Examples 1 and 2 and Comparative Example. The term "Image Height" used in the figure refers to the distance from the point 0 on the photosensitive drum 2 corresponding to the center line of the paper sheet T being conveyed (the center line thereof in the direction orthogonal to the direction of conveyance) to any point thereon along the longitudinal direction (main scanning direction or axial direction) of the photosensitive drum 2. The downward main scanning direction in FIG. 3 is the positive direction of the "Image Height".

The graph shown in FIG. 11 reveals that in Example 1 the intensity distribution of static eliminating light has been improved in evenness as compared to Comparative Example. The graph also reveals that in Example 2 the intensity distribution of static eliminating light has been further improved in evenness as compared to Example 1.

Although the preferred embodiments of the present disclosure have been here to fore described, the present disclosure is not limited by the above embodiments and can be implemented in various forms.

For example, although in the above embodiments the distal end of the distal side portion of the restricting protrusion 150 has a circular shape having an area, the shape of the distal end is not limited to this. The distal end of the distal side portion of the restricting protrusion 150 may have a pointed shape having substantially no area.

The shape of the proximal side portion 156 of the restricting protrusion 150 is not limited to the approximately cylindrical shape having a substantially constant cross-sectional area and may be, for example, a shape increasing the diameter toward the proximal end.

Although the above embodiments have described the image forming apparatus as the printer 1 configured to form a monochromatic toner image, the image forming apparatus is not limited to this. No particular limitation is placed on the type of the image forming apparatus of the present disclosure and the image forming apparatus may be a copier, a printer, a facsimile machine or a multifunction peripheral including these devices.

The recording material for use in image transfer is not limited to a paper sheet and may be, for example, a film sheet.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A static eliminating device configured to irradiate a charged surface of an image carrier with static eliminating light to statically eliminate the image carrier, the static eliminating device including:

a housing;

a substrate mounted to the housing;

a light-emitting part mounted on a mounting surface of the substrate and configured to emit the static eliminating light;

a partition member connected to the housing to cover the substrate and the light-emitting part and face a portion of the housing to which the substrate and the light-emitting part are mounted so that an opening facing the surface of the image carrier is formed in a light-emitting region across which light is delivered from the light-emitting part to the surface of the image carrier; and a restricting protrusion surrounded by the surface of the image carrier, the substrate, and the light-emitting part, protruding from the portion of the housing toward the partition member, abutting at a distal end thereof against the partition member to support the partition member, and restricting the position of the partition member to ensure the formation of the opening, wherein at least a distal side portion of the restricting protrusion located within the light-emitting region in a direction extending from the portion of the housing toward the partition member has a tapered shape narrowing with approach toward the partition member.

2. The static eliminating device according to claim 1, wherein a surface of the substrate opposite to the mounting surface is mounted to the portion of the housing, and the distal side portion having a tapered shape narrowing with approach toward the partition member is located closer to the partition member in a thickness direction of the substrate than the mounting surface.

3. The static eliminating device according to claim 2, wherein a proximal side portion of the restricting protrusion which is a remaining portion thereof closer to the portion of the housing in the thickness direction of the substrate than the mounting surface has a substantially constant diameter.

4. The static eliminating device according to claim 1, wherein the distal side portion has the shape of an approximately circular truncated cone.

5. The static eliminating device according to claim 1, wherein the distal side portion has a shape in which the cross-sectional area taken along a direction from the light-emitting part toward the surface of the image carrier approximately exponentially decreases in the direction from the portion of the housing toward the partition member.

6. The static eliminating device according to claim 1, wherein a proximal side portion of the restricting protrusion which is a remaining portion thereof closer to the portion of the housing in the direction from the portion of the housing toward the partition member has a substantially constant diameter.

7. The static eliminating device according to claim 6, wherein the proximal side portion has an approximately cylindrical shape.

8. The static eliminating device according to claim 1, wherein the light-emitting part is configured to emit the static eliminating light along an extending direction of the substrate.

9. The static eliminating device according to claim 1, wherein the light-emitting part includes a plurality of light-emitting parts aligned along an axial direction of the image carrier, and the restricting protrusion includes a plurality of restricting protrusions aligned along the axial direction of the image carrier.

10. An image forming apparatus including:

an image carrier;

a charging section configured to charge the image carrier;

an exposure section configured to form an electrostatic latent image on a surface of the image carrier;

a developing section configured to develop the electrostatic latent image formed by the exposure section with toner to form a toner image; and the static eliminating device according to claim 1 and configured to irradiate the charged surface of the image carrier with static eliminating light to statically eliminate the image carrier.

* * * * *